US006126405A

United States Patent [19]

Kawaguchi et al.

[11] Patent Number: 6,126,405

[45] Date of Patent: Oct. 3, 2000

[54] UNDULATING CURRENT SUPPLYING MEANS FOR THE SOLENOID OF A DISPLACEMENT CONTROL VALVE IN A VARIABLE DISPLACEMENT COMPRESSOR

[75] Inventors: Masahiro Kawaguchi; Masanori Sonobe; Hiroshi Kubo; Tetsuhiko Fukanuma, all of Kariya, Japan

[73] Assignee: Kabushiki Kaisha Toyoda Jidoshokki Seisakusho, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/876,410

[22] Filed: Jun. 16, 1997

[30] Foreign Application Priority Data

Jun. 17, 1996 [JP] Japan ..... 8-155562

[51] Int. Cl.[7] ..... F04B 1/26

[52] U.S. Cl. ..... 417/222.2; 417/270; 417/278; 62/228.5

[58] Field of Search ..... 417/213, 222.1, 417/222.2, 270, 278; 62/227, 228.5

[56] References Cited

U.S. PATENT DOCUMENTS

| | | | |
|---|---|---|---|
| 4,606,705 | 8/1986 | Parekh . | |
| 4,848,101 | 7/1989 | Suzuki | 62/228.5 |
| 4,882,909 | 11/1989 | Terauchi | 417/270 |
| 4,946,350 | 8/1990 | Suzuki et al. | 417/270 |
| 5,063,829 | 11/1991 | Takao et al. | 417/222.2 |
| 5,145,326 | 9/1992 | Kimura et al. | 417/222.2 |
| 5,173,032 | 12/1992 | Taguchi et al. . | |
| 5,807,076 | 9/1998 | Kawaguchi et al. | 417/222.2 |

FOREIGN PATENT DOCUMENTS

| | | | |
|---|---|---|---|
| 0628722 | 12/1994 | European Pat. Off. | 417/222.2 |
| 1121572 | 5/1989 | Japan | 62/228.5 |
| 337378 | 2/1991 | Japan . | |
| 5-38937 A | 2/1993 | Japan | 62/228.5 |
| 6346845 | 12/1994 | Japan . | |
| 2153922 | 8/1985 | United Kingdom . | |

*Primary Examiner*—Charles G. Freay
*Assistant Examiner*—Cheryl J. Tyler
*Attorney, Agent, or Firm*—Morgan & Finnegan, L.L.P.

[57] ABSTRACT

A compressor has a drive plate located in a crank chamber and tiltably mounted on a drive shaft and a piston operably coupled to the drive plate and located in a cylinder bore. The inclination of the drive plate is variable according to a difference between the pressure in the crank chamber and the pressure in the cylinder bore. The compressor has an adjusting mechanism for adjusting the pressure in one of the crank chamber and a suction chamber to vary the difference between the pressure in the crank chamber and the pressure in the cylinder bore. The adjusting mechanism includes a gas passage for passing the gas used for adjusting the pressure and a control valve for adjusting the amount of the gas flowing in the gas passage. The control valve includes a valve body, a reacting member and a solenoid. The valve body adjusts the opening size of the gas passage. The reacting member moves the valve body in accordance with the pressure of the gas supplied to the compressor from the external circuit. The solenoid biases the valve body in a direction with the force based on a value of current supplied to the solenoid. A supplying apparatus supplies undulating current to the solenoid. The supplying apparatus varies the average value of the undulating current to vary the biasing force of the solenoid.

32 Claims, 7 Drawing Sheets

UNDULATING CURRENT SUPPLYING MEANS FOR THE SOLENOID OF A DISPLACEMENT CONTROL VALVE IN A VARIABLE DISPLACEMENT COMPRESSOR

BACKGROUND OF THE INVENTION

1. Field of the Invention

The present invention relates to variable displacement compressors that are used in vehicle air conditioners and to a method for controlling the compressors. More particularly, the present invention relates to a variable displacement compressor equipped with a displacement control valve that controls the inclination of a swash plate and to a method for controlling the compressor.

2. Description of the Related Art

A typical variable displacement compressor has a cam plate tiltably supported on a rotary shaft. The inclination of the cam plate is controlled based on the difference between the pressure in a crank chamber and the pressure in the cylinder bores. The stroke of each piston is varied in accordance with the inclination of the cam plate. The displacement of the compressor is varied, accordingly. The compressor is provided with a discharge chamber that is connected to the crank chamber by a supply passage. A displacement control valve is located in the supply passage. The control valve controls the flow rate of refrigerant gas from the discharge chamber to the crank chamber thereby controlling the pressure in the crank chamber. Accordingly, the difference between the pressure in the crank chamber and the pressure in the cylinder bores is varied.

The control valve includes a valve body for controlling the opening of the supply passage and a transmission mechanism for transmitting changes in the suction pressure to the valve body. The valve body is selectively moved in a direction opening the supply passage and in a direction closing the passage. The transmission mechanism changes the position of the valve body in accordance with the suction pressure acting thereon for changing the opening of the supply passage. The control valve includes a solenoid having a steel core and a plunger. The plunger is selectively moved toward and away from the core. Applying electrical current to the solenoid generates an attractive force between the core and the plunger. The magnitude of the force varies in accordance with the value of the current. The force moves the valve body in one of the moving directions. Therefore, the required magnitude of suction pressure for moving the valve body in a direction opening or in a direction closing the supply passage is changed in accordance with the value of current supplied to the solenoid. In other words, even if the suction pressure is constant, the opening of the supply passage is changed in accordance with changes in the value of the current supplied to the solenoid.

Applying a constant direct current to the solenoid creates a constant attractive force between the fixed core and the plunger. The magnitude of the force is proportional to the applied current value. If the suction pressure is constant, the constant attractive force allows the plunger to remain at a substantially static position. In this state, if the current value to the solenoid is changed, the plunger is moved from the substantially static position. The plunger is slidably retained in the housing of the housing. Thus, frictional force is generated between the plunger and the housing. The maximum static frictional resistance between the plunger and the housing is greater than the kinetic frictional resistance. Moving a static plunger thus requires a force that is greater than the maximum static frictional resistance force.

Therefore, the attractive force between the core and the plunger needs to be relatively large, which is accomplished by sending a relatively large current to the solenoid or by enlarging the size of the solenoid. This increases the power consumption of the solenoid.

A greater power consumption increases load on auxiliary components such as the alternator. This results in a greater load on an external drive source such as an engine that drives the compressor and the auxiliary components. Since the space for a compressor in an engine compartment is relatively small, the compressor must be compact. However, increasing the size of the solenoid enlarges the compressor.

Variable displacement compressors often have a rotary shaft directly connected to an external drive source such as an engine without an electromagnetic clutch located in between. In such a clutchless system, the compressor is operated with the minimum displacement even if refrigeration is not necessary. Therefore, the load on the external drive source must be minimized in a clutchless system. Since it has no electromagnetic clutch, a clutchless system consumes relatively little electricity. This reduces the load on the auxiliary components and the external drive source. For further reducing the power consumption, the value of current supplied to the solenoid in the control valve must be decreased. However, this results in a narrower range of current values that can be supplied to the solenoid. Altering the current value to the solenoid only slightly does not generate a force greater than the maximum static frictional resistance force of the static plunger and does not move the plunger. If the range of possible changes in current value to the solenoid is narrow, it is difficult to finely and accurately control the control valve.

Supplying current to a solenoid warms the solenoid. Temperature changes in the solenoid vary the electrical resistance of the solenoid. As a result, the actual current value in the solenoid deviates from a target current value. This prevents the control valve from being accurately controlled.

SUMMARY OF THE INVENTION

Accordingly, it is an objective of the present invention to provide a variable displacement compressor and a method that accurately control the displacement control valve.

Another objective of the present invention is to provide a variable displacement compressor and a method that reduce the consumption power and the size of the displacement control valve.

To achieve the above objective, the compressor according to the present invention has a drive plate located in a crank chamber and tiltably mounted on a drive shaft and a piston operably coupled to the drive plate and located in a cylinder bore. The drive plate converts rotation of the drive shaft to reciprocating movement of the piston in the cylinder bore. The piston compresses gas supplied to the cylinder bore from a separate external circuit by way of a suction chamber and discharges the compressed gas to the external circuit by way of a discharge chamber. The inclination of the drive plate is variable according to a difference between the pressure in the crank chamber and the pressure in the cylinder bore. The piston moves by a stroke based on the inclination of the drive plate to control the displacement of the compressor. The compressor further includes means for adjusting the pressure in one of the crank chamber and the suction chamber to vary the difference between the pressure in the crank chamber and the pressure in the cylinder bore. The adjusting means includes a gas passage for passing the gas used for adjusting the pressure and a control valve for adjusting the amount of the gas flowing in the gas passage. The control valve includes a valve body, a reacting member and a solenoid. The valve body adjusts the opening size of the gas passage. The valve body is movable in the first direction and in a second direction opposite to the first direction. The valve body moves in the first direction to open the gas passage and moves in the second direction to close the gas passage. The reacting member moves the valve body in accordance with the pressure of the gas supplied to the compressor from the external circuit. The solenoid biases the valve body in one of the first direction and the second direction with the force based on a value of electric current supplied to the solenoid. Supplying means supplies undulating current to the solenoid. The supplying means varies the average value of the undulating current to vary the biasing force of the solenoid.

BRIEF DESCRIPTION OF THE DRAWINGS

The invention, together with objects and advantages thereof, may best be understood by reference to the following description of the presently preferred embodiments together with the accompanying drawings in which:

FIG. 5(*b*) is a diagram illustrating the behavior with time of the current supplied to a solenoid according to the first embodiment;

DETAILED DESCRIPTION OF THE PREFERRED EMBODIMENTS

A variable displacement compressor according to a first embodiment of the present invention will now be described with reference to FIGS. 1 to 6.

Figure 1:
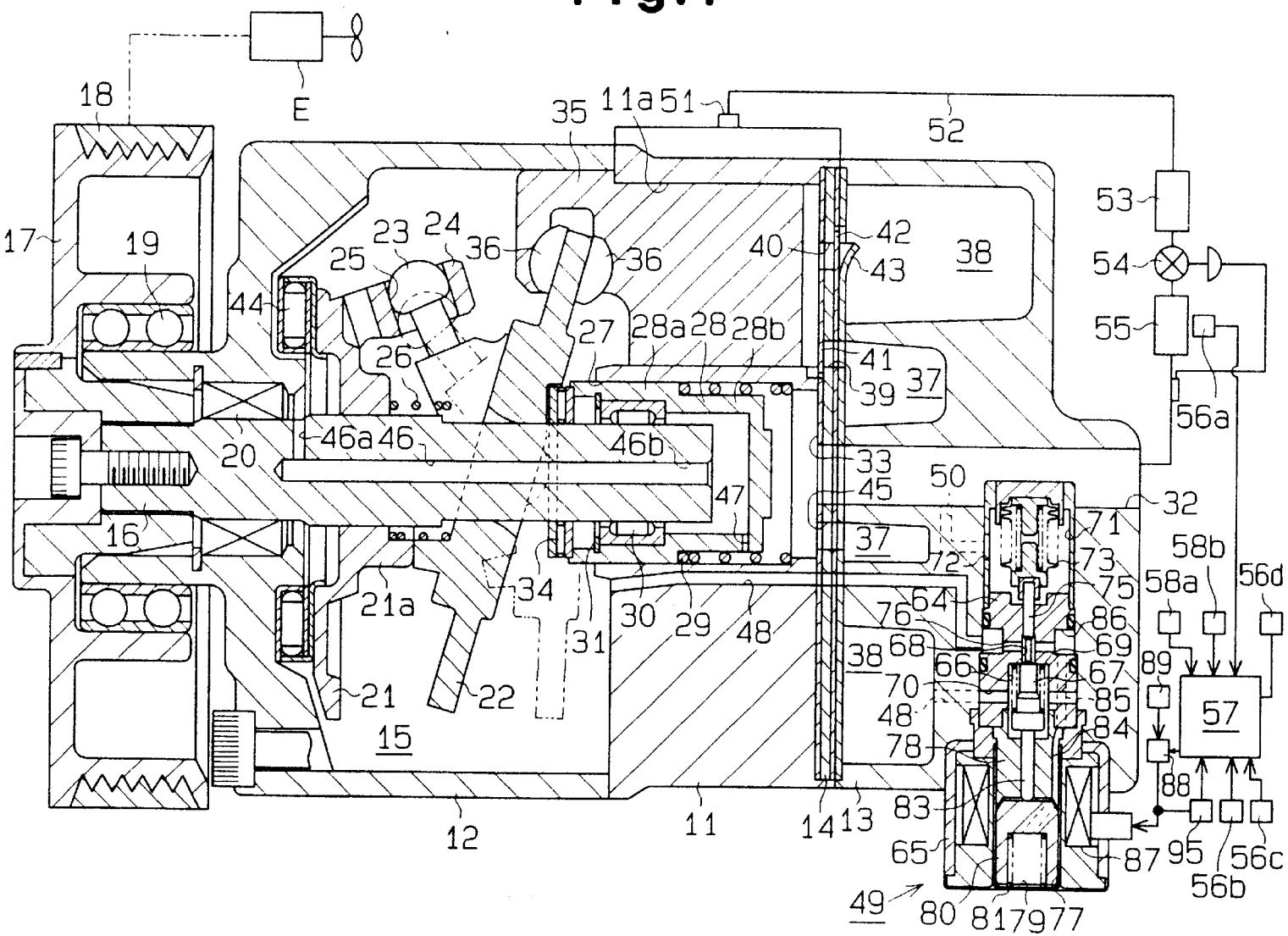
FIG. 1 is cross-sectional view illustrating a variable displacement compressor according to a first embodiment of the present invention.

As shown in FIG. 1, a cylinder block 11 constitutes a part of the compressor housing. A front housing 12 is secured to the front end face of a cylinder block 11. A rear housing 13 is secured to the rear end face of the cylinder block 11 with a valve plate 14 in between. A crank chamber 15 is defined by the inner walls of the front housing 12 and the front end face of the cylinder block 11.

A rotary shaft 16 is rotatably supported in the front housing 12 and the cylinder block 11. The front end of the rotary shaft 16 protrudes from the crank chamber 15 and is secured to a pulley 17. The pulley 17 is directly coupled to an external drive source (a vehicle engine E in this embodiment) by a belt 18. The compressor of this embodiment is a clutchless type variable displacement compressor having no clutch between the rotary shaft 16 and the external drive source. The pulley 17 is supported by the front housing 12 with an angular bearing 19. The angular bearing 19 transfers thrust and radial loads that act on the pulley 17 to the housing 12.

A lip seal 20 is located between the rotary shaft 16 and the front housing 12 for sealing the crank chamber 15. The lip seal 20 prevents the pressure in the crank chamber 15 from leaking.

A substantially disk-like swash plate 22 is supported by the rotary shaft 16 in the crank chamber 15 to be slidable along and tiltable with respect to the axis of the shaft 16. The swash plate 22 is provided with a pair of guiding pins 23, each having a guide ball at the distal end and being fixed to the swash plate 22. A rotor 21 is fixed to the rotary shaft 16 in the crank chamber 15. The rotor 21 rotates integrally with the rotary shaft 16. The rotor 21 has a support arm 24 protruding toward the swash plate 22. A pair of guide holes 25 are formed in the support arm 24. Each guide pin 23 is slidably fitted into the corresponding guide hole 25. The cooperation of the arm 24 and the guide pins 23 permits the swash plate 22 to rotate together with the rotary shaft 16. The cooperation also guides the tilting of the swash plate 22 and the movement of the swash plate 22 along the axis of the rotary shaft 16. As the swash plate 22 slides rearward toward the cylinder block 11, the inclination of the swash plate 22 decreases.

A coil spring 26 is located between the rotor 21 and the swash plate 22. The spring 26 urges the swash plate 22 rearward, or in a direction decreasing the inclination of the swash plate 22. The rotor 21 is provided with a projection 21*a* on its rear end face. The abutment of the swash plate 22 against the projection 21*a* prevents the inclination of the swash plate 22 beyond the predetermined maximum inclination.

Figure 2:
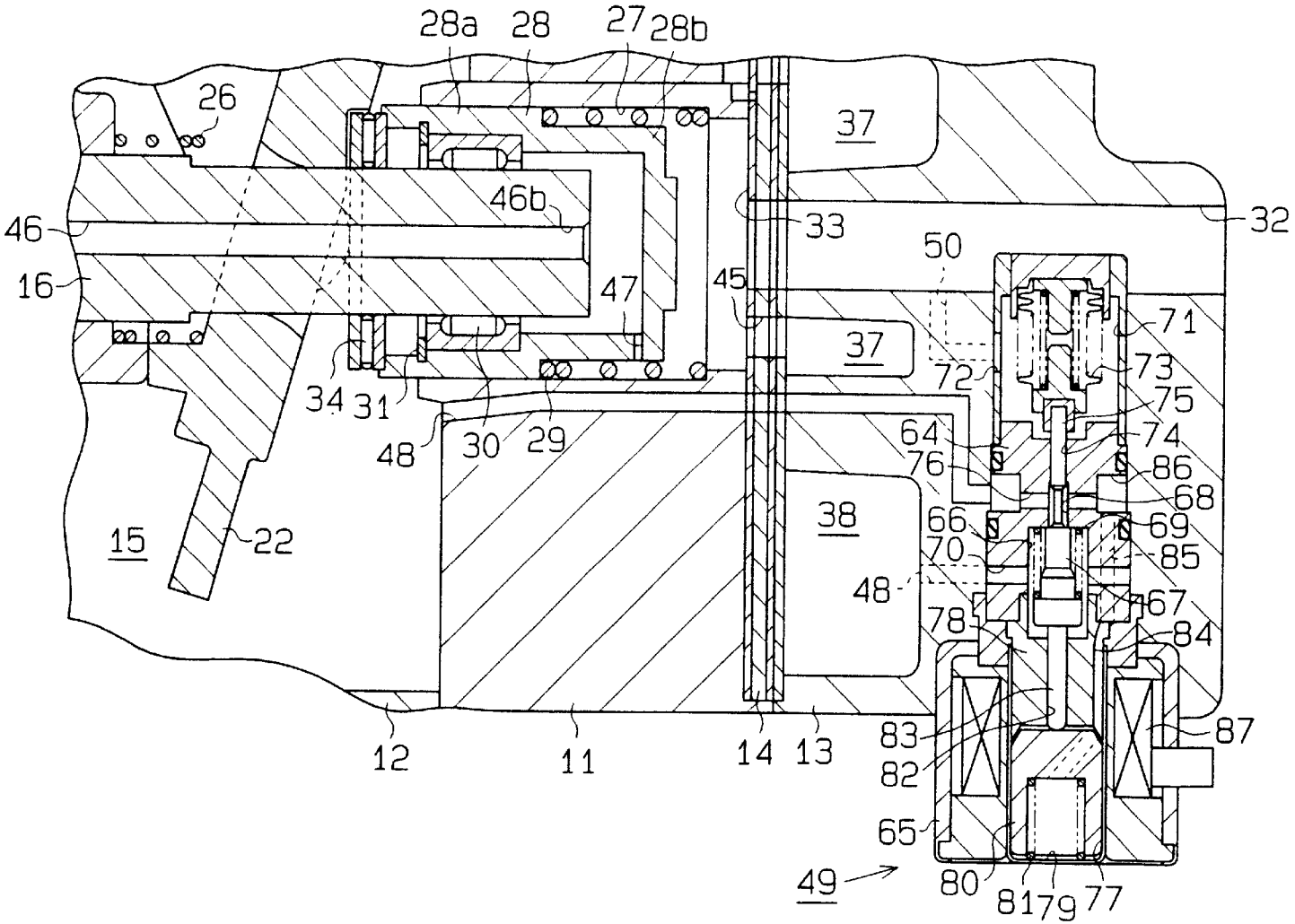
FIG. 2 is an enlarged partial cross-sectional view illustrating the compressor of FIG. 1 when the inclination of the swash plate is maximum.
Figure 3:
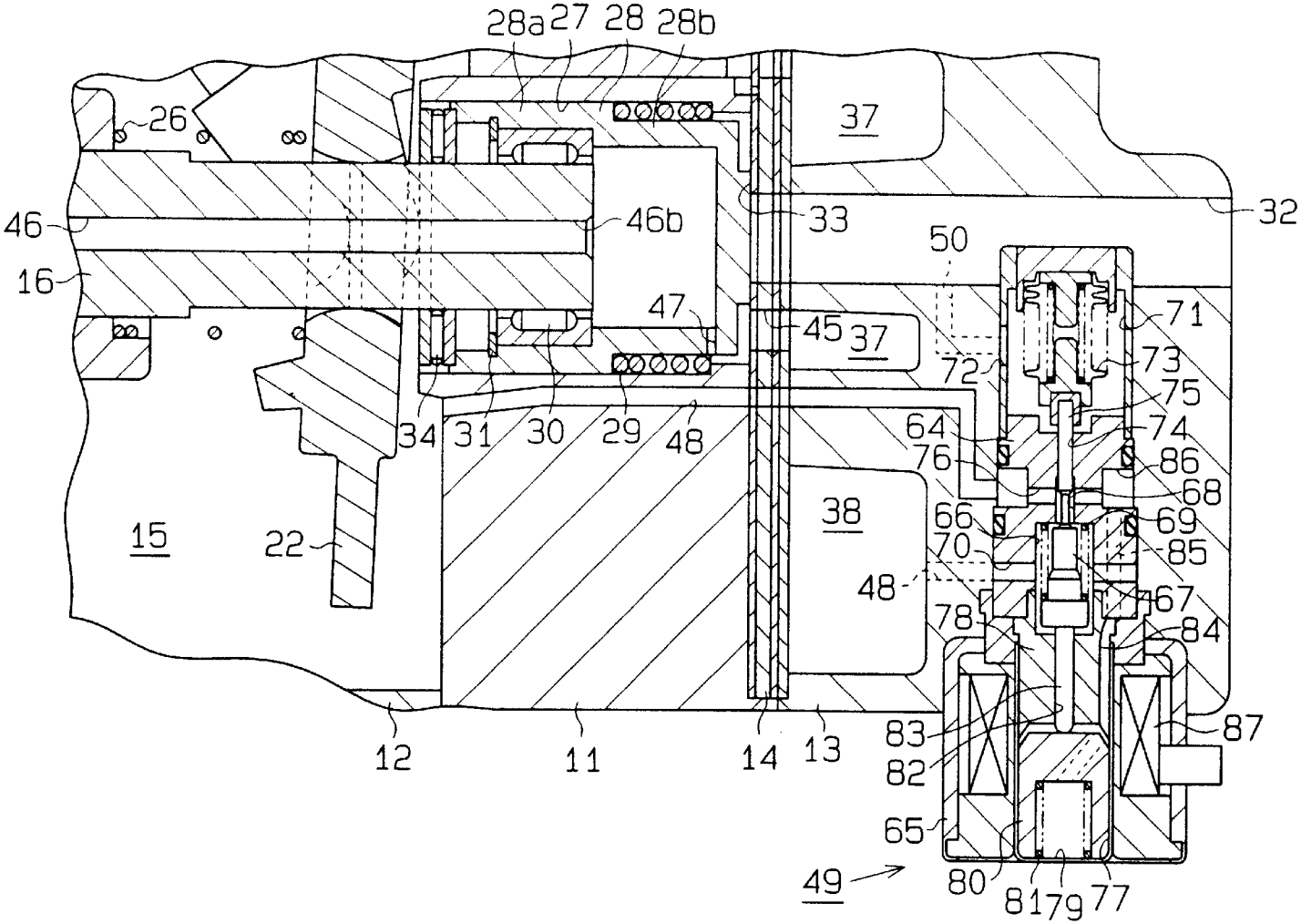
FIG. 3 is an enlarged partial cross-sectional view illustrating the compressor of FIG. 1 when the inclination of the swash plate is minimum.

As shown in FIGS. 1 to 3, a shutter chamber 27 is defined at the center portion of the cylinder block 11 extending along the axis of the rotary shaft 16. A hollow cylindrical shutter 28 is accommodated in the shutter chamber 27. The shutter 28 slides along the axis of the rotary shaft 16. The shutter 28 has a large diameter portion 28*a* and a small diameter portion 28*b*. A coil spring 29 is located between a step, which is defined by the large diameter portion 28*a* and the small diameter portion 28*b*, and a wall of the shutter chamber 27. The coil spring 29 urges the shutter 28 toward the swash plate 22.

The rear end of the rotary shaft 16 is inserted in the shutter 28. A radial bearing 30 is fixed to the inner wall of the large diameter portion 28*a* of the shutter 28 by a snap ring 31. Therefore, the radial bearing 30 moves with the shutter 28 along the axis of the rotary shaft 16. The rear end of the rotary shaft 16 is supported by the inner wall of the shutter chamber 27 with the radial bearing 30 and the shutter 28 in between.

A suction passage 32 is defined at the center portion of the rear housing 13 and the valve plate 14. The passage 32 extends along the axis of the rotary shaft 16 and is communicated with the shutter chamber 27. The suction passage 32 functions as a suction pressure area. A positioning surface 33 is formed on the valve plate 14 about the inner opening of the suction passage 32. The rear end of the shutter 28 abuts against the positioning surface 33. Abutment of the shutter 28 against the positioning surface 33 prevents the shutter 28 from further moving rearward away from the rotor 21. The abutment also disconnects the suction passage 32 from the shutter chamber 27.

A thrust bearing 34 is supported on the rotary shaft 16 and is located between the swash plate 22 and the shutter 28. The thrust bearing 34 slides along the axis of the rotary shaft 16. The force of the coil spring 29 constantly retains the thrust bearing 34 between the swash plate 22 and the shutter 28. The thrust bearing 34 prevents the rotation of the swash plate 22 from being transmitted to the shutter 28.

The swash plate 22 moves rearward as its inclination decreases. As it moves rearward, the swash plate 22 pushes the shutter 28 rearward through the thrust bearing 34. Accordingly, the shutter 28 moves toward the positioning surface 33 against the force of the coil spring 29. As shown in FIG. 3, when the swash plate 22 reaches the minimum inclination, the rear end of the shutter 28 abuts against the positioning surface 33. In this state, the shutter 28 is located at the closed position for disconnecting the shutter chamber 27 from the suction passage 32.

A plurality of cylinder bores 11*a* extend through the cylinder block 11 and are located about the axis of the rotary shaft 16. The cylinder bores 11*a* are spaced apart at equal intervals. A single-headed piston 35 is accommodated in each cylinder bore 11*a*. A pair of semispherical shoes 36 are fitted between each piston 35 and the swash plate 22. A semispherical portion and a flat portion are defined on each shoe 36. The semispherical portion slidably contacts the piston 35 while the flat portion slidably contacts the swash plate 22. The swash plate 22 is rotated by the rotary shaft 16 through the rotor 21. The rotating movement of the swash plate 22 is transmitted to each piston 35 through the shoes 36 and is converted to linear reciprocating movement of each piston 35 in the associated cylinder bore 11*a*.

A suction chamber 37 is defined in the center portion of the rear housing 13. The suction chamber 37 is communicated with the shutter chamber 27 via a communication hole 45. A discharge chamber 38 is defined about the suction chamber 37 in the rear housing 13. Suction ports 39 and discharge ports 40 are formed in the valve plate 14. Each suction port 39 and each discharge port 40 correspond to one of the cylinder bores 11*a*. Suction valve flaps 41 are formed on the valve plate 14. Each suction valve flap 41 corresponds to one of the suction ports 39. Discharge valve flaps 42 are formed on the valve plate 14. Each discharge valve flap 42 corresponds to one of the discharge ports 40.

As each piston 35 moves from the top dead center to the bottom dead center in the associated cylinder bore 11*a*, refrigerant gas in the suction chamber 37 is drawn into each cylinder bore 11*a* through the associated suction port 39 while causing the associated suction valve flap 41 to flex to an open position. As each piston 35 moves from the bottom dead center to the top dead center in the associated cylinder bore 11*a*, refrigerant gas is compressed in the cylinder bore 11*a* and discharged to the discharge chamber 38 through the associated discharge port 40 while causing the associated discharge valve flap 42 to flex to an open position. Retainers 43 are formed on the valve plate 14. Each retainer 43 corresponds to one of the discharge valve flaps 42. The opening amount of each discharge valve flap 42 is defined by contact between the valve flap 42 and the associated retainer 43.

A thrust bearing 44 is located between the front housing 12 and the rotor 21. The thrust bearing 44 carries the reactive force of gas compression acting on the rotor 21 through the pistons 35 and the swash plate 22.

A pressure release passage 46 is defined at the center portion of the rotary shaft 16. The pressure release passage 46 has an inlet 46*a*, which opens to the crank chamber 15 in the vicinity of the lip seal 20, and an outlet 46*b* that opens in the interior of the shutter 28. A pressure release hole 47 is formed in the peripheral wall near the rear end of the shutter 28. The hole 47 communicates the interior of the shutter 28 with the shutter chamber 27.

A supply passage 48 is defined in the rear housing 13, the valve plate 14 and the cylinder block 11 for communicating the discharge chamber 38 with the crank chamber 15. A displacement control valve 49 is accommodated in the rear housing 13 midway in the supply passage 48. A pressure introduction passage 50 is defined in the rear housing 13 for communicating the control valve 49 with the suction passage 32. Thus, suction pressure Ps is communicated with the control valve 49.

Figure 4:
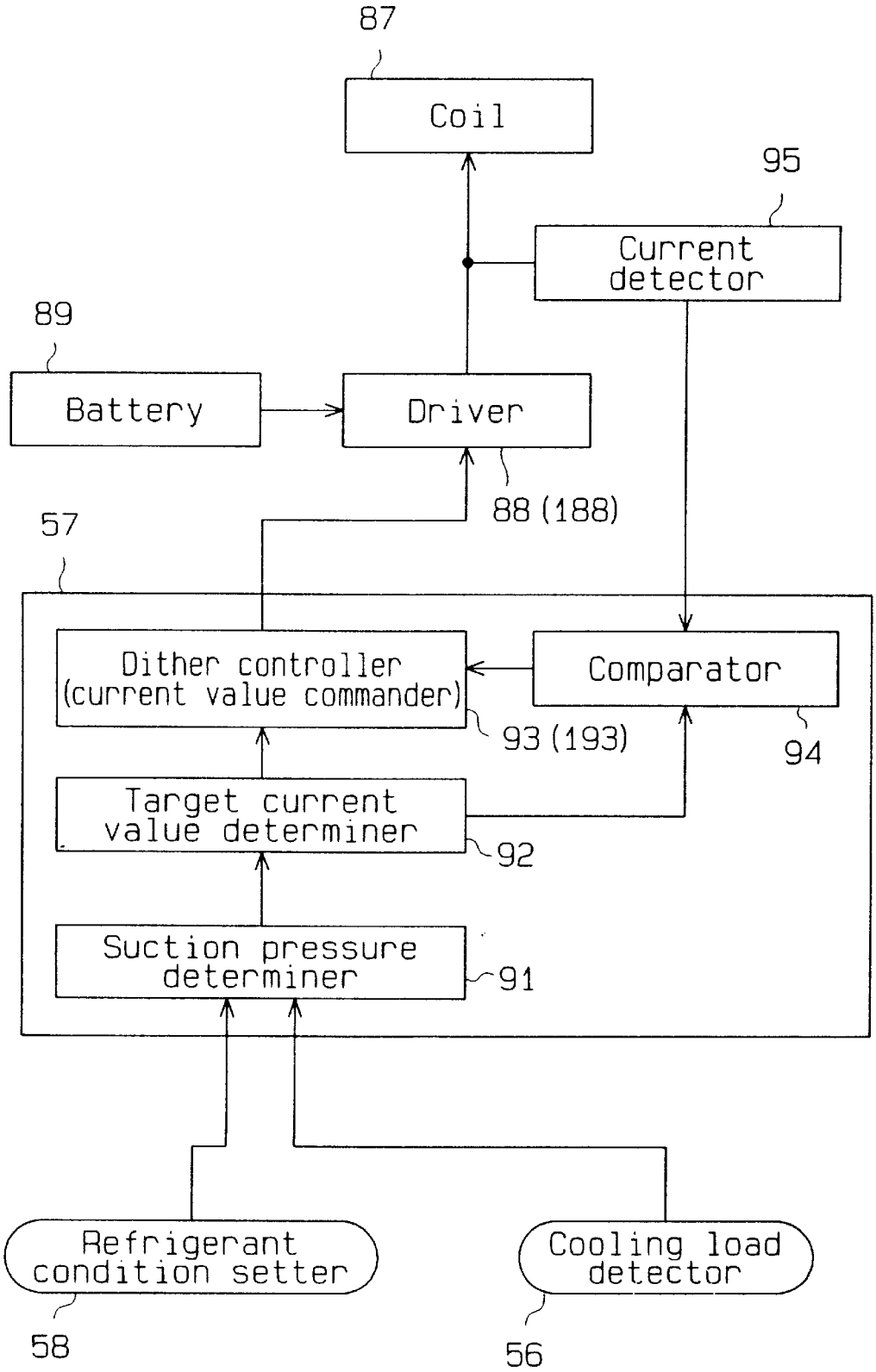
FIG. 4 is a block diagram illustrating a construction for controlling the current supplied to a solenoid.

An outlet port 51 is formed in the cylinder block 11 and is communicated with the discharge chamber 38. The outlet port 51 is connected to the suction passage 32 by an external refrigerant circuit 52. The refrigerant circuit 52 includes a condenser 53, an expansion valve 54 and an evaporator 55. The expansion valve 54 controls the flow rate of refrigerant in accordance with the temperature of refrigerant gas at the outlet of the evaporator. A temperature sensor 56*a* is located in the vicinity of the evaporator 55. The temperature sensor 56*a* detects the temperature of the evaporator 55 and issues signals relating to the detected temperature to a control computer 57. The computer 57 is connected to various devices including an air conditioner starting switch 58*a*, a temperature adjuster 58*b*, a compartment temperature sensor 56*b*, an engine speed sensor 56*c* and an outside air temperature sensor 56*d*. A passenger sets a desirable compartment temperature, or a target temperature, by the temperature adjuster 58*b*. The temperature sensor 56*a*, the compartment temperature sensor 56*b*, the engine speed sensor 56*c* and outside air temperature sensor 56*d* consist a cooling load detector 56 (as shown in FIG. 4). The starting switch 58*a* and the temperature adjuster 58*b* comprise a refrigerant condition setter 58 (as shown in FIG. 4).

As shown in FIGS. 1 to 3, the control valve 49 includes a housing 64 and the solenoid 65, which are secured to each other. A valve chamber 66 is defined between the housing 64 and the solenoid 65. The valve chamber 66 is connected to the discharge chamber 38 by a first port 70 and the supply passage 48. A valve body 67 is arranged in the valve chamber 66. A valve hole 68 is defined extending axially in the housing 64 and opens in the valve chamber 66. The area about the opening of the valve hole 68 functions as a valve seat, against which a top end of the valve body 67 abuts. A first coil spring 69 extends between the valve body 67 and a wall of the valve chamber 66 for urging the valve body 67 in a direction opening the valve hole 68.

A pressure sensing chamber 71 is defined at the upper portion of the housing 64. The pressure sensing chamber 71 is provided with a bellows 73 and is connected to the suction passage 32 by a second port 72 and the pressure introduction passage 50. Suction pressure Ps in the suction passage 32 is thus introduced to the chamber 71 via the passage 50. The bellows 73 functions as a pressure sensing member for detecting the suction pressure Ps. A first guide hole 74 is defined in the housing 64 between the pressure sensing chamber 71 and the valve hole 68. The axis of the first guide hole 74 is aligned with the axis of the valve hole 68. The bellows 73 is connected to the valve body 67 by a first rod 75. The first rod 75 has a small diameter portion, which extends through the valve hole 68. A clearance between the small diameter portion of the rod 75 and the valve hole 68 permits the flow of refrigerant gas.

A third port 76 is defined in the housing 64 between the valve chamber 66 and the pressure sensing chamber 71. The third port 76 extends intersecting the valve hole 68. The valve hole 68 is connected to the crank chamber 15 by the third port 76 and the supply passage 48. Thus, the first port 70, the valve chamber 66, the valve hole 68 and the third port 76 constitute a part of the supply passage 48.

An accommodating hole 77 is defined in the center portion of the solenoid 65. A fixed steel core 78 is fitted in the upper portion of the hole 77. A plunger chamber 79 is defined by the fixed core 78 and inner walls of the hole 77 at the lower portion of the hole 77 in the solenoid 65. A cylindrical plunger 80 is accommodated in the plunger chamber 79. The plunger 80 slides along the axis of the chamber 79. A second coil spring 81 extends between the plunger 80 and the bottom of the hole 77. The force of the second coil spring 81 is smaller than the force of the first coil spring 69. A second guide hole 82 is defined in the fixed core 78 between the plunger chamber 79 and the valve chamber 66. The axis of the second guide hole 82 is aligned with the axis of the first guide hole 74. A second rod 83 is formed integrally with the valve body 67 and projects downward from the bottom of the valve body 67. The second rod 83 is accommodated in and slides with respect to the second guide hole 82. The first spring 69 urges the valve body 67 downward, while the second spring 81 urges the plunger 80 upward. This allows the lower end of the second rod 83 to constantly contact the plunger 80. In other words, the valve body 67 moves integrally with the plunger 80 with the second rod 83 in between.

A small chamber 86 is defined by the inner wall of the rear housing 13 and the circumference of the valve 49 at a position corresponding to the third port 76. The small chamber 86 is communicated with the valve hole 68 by the third port 76. A communication groove 84 is formed in a side of the fixed core 78, and opens in the plunger chamber 79. A communication passage 85 is formed in the middle portion of the housing 64 for communicating the groove 84 with the small chamber 86. The plunger chamber 79 is connected to the valve hole 68 by the groove 84, the passage 85, the chamber 86, and the third port 76. Therefore, the pressure in the plunger chamber 79 is equalized with the pressure in the valve hole 68 (crank chamber pressure Pc).

A cylindrical coil 87 is wound about the core 78 and the plunger 80. The coil 87 is connected to a battery 89, which functions as an external power source, by the driver 88.

FIG. 4 is a block diagram showing the construction of an apparatus for controlling the current supplied to the coil 87 in the control valve 49. The computer 57 functions as a suction pressure determiner 91, a target current value determiner 92, a dither controller 93 and a comparator 94.

As shown in FIGS. 1 and 4, the refrigerant condition setter 58 and the cooling load detector 56 provide the suction pressure determiner 91 with various data necessary for controlling the valve 49. The data includes, for example, a target temperature set by the temperature adjuster 58*b*, the temperature detected by the temperature sensor 56*a*, the compartment temperature detected by the temperature sensor 56*b*, the ON/OFF signal from the air conditioner starting switch 58*a*, the engine speed detected by the engine speed sensor 58*c* and the temperature of outside air detected by the outside air temperature sensor 56*d*. The determiner 91 computes a target suction pressure based on the inputted data and transmits data of the target suction pressure to the target current value determiner 92. The determiner 92 computes a target current value based on the data of the target suction pressure and transmits data of the target current value to the dither controller 93. The dither controller 93 computes a duty ratio shown in FIG. 5(*a*) based on the data of the target current value and transmits the duty signal having the computed duty ratio to the driver 88. The driver 88 converts a constant direct current supplied from the battery 89 into an undulating current shown in FIG. 5(*b*) in accordance with the duty signal from the dither controller 93. The driver 88 then transmits the undulating current to the coil 87 in the valve 49.

A current detector 95 is connected to the driver 88 and the coil 87 for detecting the undulating current transmitted from the driver 88 to the coil 87. The current detector 95 transmits data of the average value of the detected undulating current to the comparator 94 in the computer 57. The data of the target current value from the determiner 92 is also transmitted to the comparator 94. The comparator 94 compares the data from the determiner 92 with the data from current detector 95. The comparator 94 transmits data of the comparison result to the dither controller 93. The dither controller 93 adjusts the duty ratio of the duty signal transmitted to the driver 88 based on the inputted data such that the average value of the undulating current to the coil 87 matches the target current value. In other words, the current supplied to the coil 87 is feedback controlled.

The operation of the above described compressor will hereafter be described.

Figure 5A:
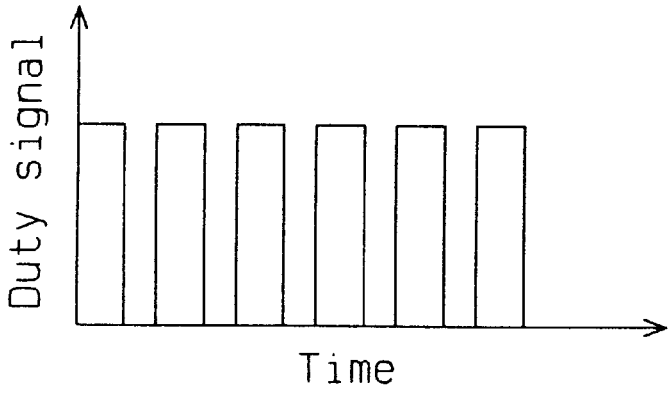
FIG. 5(*a*) is a diagram illustrating the behavior with time of a duty signal supplied to a driver according to the first embodiment.
Figure 5B:
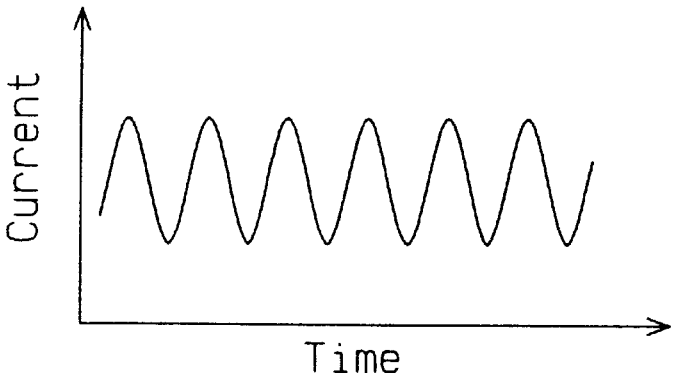

When the switch 58*a* is turned on, if the compartment temperature detected by the temperature sensor 56*b* is equal to or greater than the value set by the temperature adjuster 58*b*, the computer 57 commands the driver 88 to excite solenoid 65. Specifically, as shown in FIG. 5(*a*), the computer 57 transmits a duty signal having a predetermined duty ratio to the driver 88. The driver 88 converts a constant current from the battery 89 into an undulating current illustrated in FIG. 5(*b*) in accordance with the inputted duty signal. As shown in FIGS. 5(*a*) and 5(*b*), the undulating current supplied to the coil 87 has fluctuations corresponding to the ratio of on-time to off-time in the duty signal. The greater the duty ratio of the duty signal becomes, that is, the greater the ratio of on-time to the total time is, the greater the average value of the undulating current to the coil 87 becomes. Contrarily, the smaller the duty ratio of the duty signal becomes, that is, the smaller the ratio of on-time to the total time is, the smaller the average value of the undulating current to the coil 87 becomes.

Supplying the undulating current to the coil 87 produces a magnetic attractive force in accordance with the current magnitude between the core 78 and the plunger 80 as illustrated in FIGS. 1 and 2. The attractive force is transmitted to the valve body 67 by the second rod 83, and thus urges the valve body 67 against the force of the first spring 69 in a direction closing the valve hole 68. On the other hand, the length of the bellows 73 changes in accordance with the suction pressure Ps in the suction passage 32 that is introduced to the pressure sensing chamber 71 via the passage 50. The changes in the length of the bellows 73 is transmitted to the valve body 67 by the first rod 75. The higher the suction pressure Ps is, the shorter the bellows 73 becomes. As the bellows 73 becomes shorter, the bellows 73 pulls the valve body 67 in a direction closing the valve hole 68.

The opening area between the valve body 67 and the valve hole 68 is determined by the equilibrium of a plurality of forces acting on the valve body 67. Specifically, the opening area is determined by the equilibrium position of the body 67, which is affected by the force of the solenoid 65, the force of the bellows 73, the force of the first spring 69, and the force of the second spring 81.

The fluctuation period of the undulating current is extremely short. The attractive force between the fixed core 78 and the plunger 80 changes in accordance with the current's fluctuation. However, the movement of the plunger 80 does not accurately corresponds to the fluctuation of the attractive force. Instead, the plunger 80 stays at a position corresponding to the average value of the undulating current and slightly vibrates in the vertical direction. Thus, the force of the plunger 80, which urges the valve body 67, is substantially increased as the average value of the undulating current increases. The plunger 67 is slightly vibrated by the vibration of the plunge 80 through the second rod 83.

Suppose the cooling load is great, the temperature in the vehicle compartment detected by the sensor 56*b* is significantly higher than a target temperature set by the temperature adjuster 58*b*. The suction pressure determiner 91 of the computer 57 sets a lower target suction pressure for a greater difference between the detected temperature and the target temperature. The target current value determiner 92 sets a higher target current value for a lower target suction pressure. The dither controller 93 sets a higher duty ratio for a higher target current value. The computer 57 therefore commands the driver 88 to transmit an undulating current having a greater average value to the coil 87 for a greater difference between the detected temperature and the target temperature. This increases the average magnitude of the attractive force between the core 78 and the plunger 80 thereby increasing the resultant force urging the valve body 67 in a direction closing the valve hole 68. This lowers the required value of pressure Ps for moving the valve body 67 in a direction closing the valve hole 68. In other words, increasing the average value of the undulating current to the valve 49 causes the valve 49 to maintain a lower suction pressure Ps (which is equivalent to a target pressure).

A smaller opening area between the valve body 67 and the valve hole 68 decreases the amount of refrigerant gas flow from the discharge chamber 38 to the crank chamber 15 via the supply passage 48. The refrigerant gas in the crank chamber 15 flows into the suction chamber 37 via the pressure release passage 46 and the pressure release hole 47. This lowers the pressure Pc in the crank chamber 15. Further, when the cooling load is great, the suction pressure Ps is high.. Accordingly, the pressure in each cylinder bore 11*a* is high. Therefore, the difference between the pressure Pc in the crank chamber 15 and the pressure in each cylinder 11*a* is small. This increases the inclination of the swash plate 22, thereby allowing the compressor to operate at a large displacement.

When the valve hole 68 in the control valve 49 is completely closed by the valve body 67, the supply passage 48 is closed. This stops the supply of the highly pressurized refrigerant gas in the discharge chamber 38 to the crank chamber 15. Therefore, the pressure Pc in the crank chamber 15 becomes substantially the same as a low pressure Ps in the suction chamber 37. The inclination of the swash plate 22 thus becomes maximum as shown in FIGS. 1 and 2, and the compressor operates at the maximum displacement. The abutment of the swash plate 22 and the projection 21*a* of the rotor 21 prevents the swash plate 22 from inclining beyond the predetermined maximum inclination.

Suppose the cooling load is small, the difference between the passenger compartment temperature detected by the sensor 56*b* and the target temperature set by the temperature adjuster 58*b* is small. The suction pressure determiner 91 of the computer 57 sets a higher target suction pressure for a smaller difference between the detected temperature and the target temperature. The target current value determiner 92 sets a lower target current value for a higher target suction pressure. The dither controller 93 sets a lower duty ratio for a lower target current value. The computer 57 therefore commands the driver 88 to transmit an undulating current having a lower average value to the coil 87 for a smaller difference between the detected temperature and the target temperature. This decreases the average magnitude of the attractive force between the core 78 and the plunger 80, thereby decreasing the resultant force that urges the valve body 67 in a direction closing the valve hole 68. This increases the required value of the pressure Ps for moving the valve body 67 in a direction closing the valve hole 68. In other words, decreasing the average value of the undulating current to the valve 49 causes the valve 49 to maintain a higher suction pressure Ps. Therefore, the suction pressure can be controlled to seek a target suction pressure.

A larger opening area between the valve body 67 and the valve hole 68 increases the amount of refrigerant gas flow from the discharge chamber 38 to the crank chamber 15. This increases the pressure Pc in the crank chamber 15. Further, when the cooling load is small, the suction pressure Ps is low and the pressure in each cylinder bores 11*a* is low. Therefore, the difference between the pressure Pc in the crank chamber 15 and the pressure in each cylinder 11*a* is great. This decreases the inclination of the swash plate 22. The compressor thus operates at a small displacement.

As cooling load approaches zero, the temperature of the evaporator 55 in the refrigerant circuit 52 drops to a frost forming temperature. When the temperature sensor 56*a* detects a temperature that is lower than the frost forming temperature, the computer 57 commands the driver 88 to de-excite the solenoid 65. Specifically, the suction pressure determiner 91 of the computer 57 sets the target suction pressure to a predetermined maximum value. The target current value determiner 92 sets the target current value to zero in accordance with the maximum target suction pressure. The dither controller 93 sets the duty ratio to zero in accordance with the target current value, which is zero. The driver 88 stops sending current to the coil 87, accordingly. This eliminates the magnetic attractive force between the core 78 and the plunger 80. The valve body 67 is then moved by the force of the first spring 69 against the force of the second spring 81, which is transmitted by the plunger 80 and the second rod 83. The valve body 67 is moved in a direction opening the valve hole 68. This maximizes the opening area between the valve body 67 and the valve hole 68. Accordingly, the gas flow from the discharge chamber 38 to the crank chamber 15 is increased. This further raises the pressure Pc in the crank chamber 15 thereby minimizing the inclination of the swash plate 22. The compressor thus operates at the minimum displacement.

When the switch 58*a* is turned off, the computer 57 commands the driver 88 to de-excite the solenoid 87. This also minimizes the inclination of the swash plate 22.

As described above, when the average value of the undulating current to the coil 87 is increased, the valve body 67 of the valve 49 functions such that the opening area of the valve hole 68 is controlled by a lower suction pressure Ps. When the average value of the undulating current to the coil 87 is decreased, on the other hand, the valve body 67 functions such that the opening area of the valve hole 68 is controlled by a higher suction pressure Ps. The compressor controls the inclination of the swash plate 22 to adjust its displacement thereby maintaining the suction pressure Ps at the target suction pressure. The valve 49 therefore changes the actual suction pressure Ps to a target suction pressure in accordance with the average value of the inputted undulating current. A compressor equipped with the control valve 49 having such functions varies the cooling ability of the air conditioner.

The shutter 28 slides in accordance with the tilting motion of the swash plate 22. As the inclination of the swash plate 22 decreases, the shutter 28 gradually reduces the cross-sectional area of the passage between the suction passage 32 and the suction chamber 37. This gradually reduces the amount of refrigerant gas that enters the suction chamber 37 from the suction passage 32. The amount of refrigerant gas that is drawn into the cylinder bores 11*a* from the suction chamber 37 gradually decreases, accordingly. As a result, the displacement of the compressor gradually decreases. This gradually lowers the discharge pressure Pd of the compressor. The load torque of the compressor gradually decreases, accordingly. In this manner, the load torque for operating the compressor does not change dramatically in a short time when the displacement decreases from the maximum to the minimum. The shock that accompanies load torque fluctuations is therefore lessened.

When the inclination of the swash plate 22 is minimum, the shutter 28 abuts against the positioning surface 33. The abutment of the shutter 28 against the positioning surface 33 prevents the inclination of the swash plate 22 from being smaller than the predetermined minimum inclination. The abutment also disconnects the suction passage 32 from the suction chamber 37. This stops the gas flow from the refrigerant circuit 52 to the suction chamber 37 thereby stopping the circulation of refrigerant gas between the circuit 52 and the compressor.

The minimum inclination of the swash plate 22 is slightly larger than zero degrees. Zero degrees refers to the angle of the swash plate's inclination when it is perpendicular to the axis of the rotary shaft 16. Therefore, even if the inclination of the swash plate 22 is minimum, refrigerant gas in the cylinder bores 11*a* is discharged to the discharge chamber 38 and the compressor operates at the minimum displacement. The refrigerant gas discharged to the discharge chamber 38 from the cylinder bores 11*a* is drawn into the crank chamber 15 through the supply passage 48. The refrigerant gas in the crank chamber 15 is drawn back into the cylinder bores 11*a* through the pressure release passage 46, a pressure release hole 47 and the suction chamber 37. That is, when the inclination of the swash plate 22 is minimum, refrigerant gas circulates within the compressor traveling through the discharge chamber 38, the supply passage 48, the crank chamber 15, the pressure release passage 46, the pressure release hole 47, the suction chamber 37 and the cylinder bores 11*a*. This circulation of refrigerant gas allows the lubricant oil contained in the gas to lubricate the moving parts of the compressor.

If the switch 58*a* is turned on and the inclination of the swash plate 22 is minimum, an increase in the compartment temperature increases the cooling load. This causes the compartment temperature detected by the sensor 56*b* to be higher than a target temperature set by the temperature adjuster 58*b*. The computer 57 commands the driver 88 to excite the solenoid 65 in accordance with the detected temperature increase. Exciting the solenoid 65 closes the supply passage 48. This stops the flow of refrigerant gas from the discharge chamber 3B into the crank chamber 15. The refrigerant gas in the crank chamber 15 flows into the suction chamber 37 via the pressure release passage 46 and the pressure release hole 47. This gradually lowers the pressure Pc in the crank chamber 15 thereby moving the swash plate 22 from the minimum inclination to the maximum inclination.

As the swash plate's inclination increases, the force of the spring 29 gradually pushes the shutter 28 away from the positioning surface 33. This gradually enlarges the cross-sectional area of gas flow from the suction passage 32 to the suction chamber 37. Accordingly, the amount of refrigerant gas flow from the suction passage 32 into the suction chamber 37 gradually increases. Therefore, the amount of refrigerant gas that is drawn into the cylinder bores 11*a* from the suction chamber 37 gradually increases. This allows the displacement of the compressor to gradually increase. Thus, the discharge pressure Pd of the compressor gradually increases and the torque necessary for operating the compressor also gradually increases accordingly. In this manner, the load torque of the compressor does not change dramatically in a short time when the displacement increases from the minimum to the maximum. The shock that accompanies load torque fluctuations is therefore lessened.

If the engine E is stopped, the compressor is also stopped (that is, the rotation of the swash plate 22 is stopped) and the supply of current to the coil 87 in the valve 49 is stopped. This de-excites the solenoid 65 thereby opening the supply passage 48. The inclination of the swash plate 22 is thus minimum. If the nonoperational state of the compressor continues, the pressures in the chambers of the compressor become equalized and the swash plate 22 is kept at the minimum inclination by the force of spring 26. Therefore, when the engine E is started again, the compressor starts operating with the swash plate 22 at the minimum inclination. This requires the minimum torque. In this manner, the shock caused by starting the compressor is reduced.

The cylindrical plunger 80 is slidably supported in the solenoid 65. Further, the first and second rods 75, 83 are integrally moved with the plunger 80 and are slidably supported by the housing 64. Frictional force is thus generated between the plunger 80, the first and the second rods 75, 83 and the surfaces contacting the parts 80, 75, 83. However, in this embodiment, the current supplied to the coil 87 of the valve 49 is an undulating current. Therefore, the magnitude of the attractive force between the core 78 and the plunger 80 is fluctuated in accordance with the fluctuation of the undulating current. Therefore, even if the suction pressure and the current supplied to the coil 87 are constant, the plunger 80 does not remain at one position but slightly oscillates in the axial direction. This prevents the effect of the maximum static frictional force, which is greater than the kinetic frictional force, between the parts 80, 75, 83 and the contacting surface.

Accordingly, the required magnitude of force for moving the plunger 80 is decreased. Therefore, when the current to the coil 87 is changed for changing the opening of the valve hole 68, the plunger 80 is quickly and securely moved to the desirable position. This allows the size and the consumption power of the solenoid 65 to be reduced. Thus, the size of the compressor is reduced and the load on the engine E from the compressor and its auxiliary components, such as the alternator, is decreased.

Static frictional force, the magnitude of which is relatively great, is avoided between the plunger 80, the first and the second rods 75, 83 and the contacting surfaces.

Therefore, even if the current value to the coil 87 is changed by a small amount, the plunger 80 is smoothly and positively-moved to the desirable position. This reduces the consumption power of the solenoid and enables the valve 49 to be subtly and accurately controlled. Such a valve 49 is optimal for clutchless type variable displacement compressors, which are required to apply a minimum load on the engines connected thereto.

Figure 6:
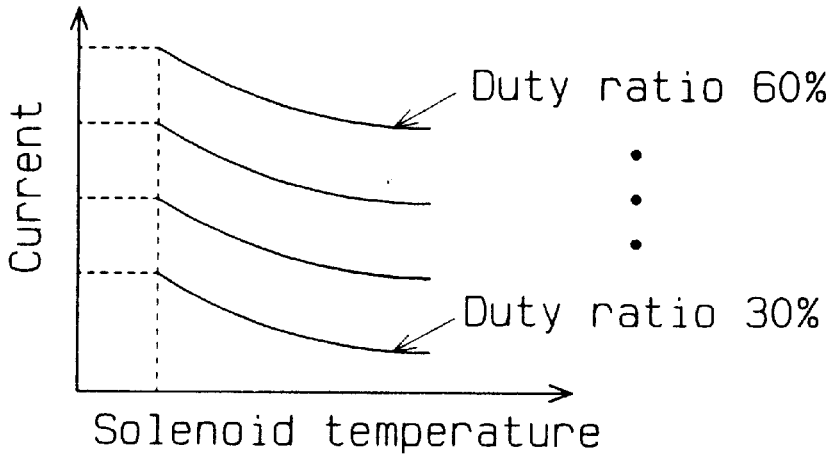
FIG. 6 is a graph showing the relationship between currents in a coil and the temperature of the coil when duty ratio is changed.

Supplying current to the coil 87 warms the coil 87. The heat changes the resistance value of the coil 87. Since the voltage of the battery 89 is substantially constant, the temperature change of the coil 87 changes the average value of the undulating current in the coil 87 as shown in FIG. 6. Thus, the actual current value supplied to the coil 87 is different from the target current value.

However, in this embodiment, the undulating current supplied to the coil 87 from the driver 88 is detected by the current detector 95. The detector 95 transmits data of the average value of the detected undulating current to the computer 57. The computer 57 compares the actual average value of the undulating current with the target current value. The computer 57 then adjusts the duty ratio of the duty signal to the driver 88 such that the average value of the undulating current matches the target current value. This feedback control allows the actual current value of the coil 87 to match the target current value regardless of changes in resistance value of the coil 87 caused by temperature changes. Thus, the control valve 49 is not affected by temperature changes and is accurately controlled.

The pressure Pd in the discharge chamber 38 acts on the valve chamber 66, which accommodates the valve body 67, via the supply passage 48 and the first port 70. The valve body 67 is located in refrigerant gas having the discharge pressure Pd and is not moved by the pressure Pd in any direction. The discharge pressure Pd thus does not affect the movement of the valve body 67.

The pressure Pc in the crank chamber 15 acts on the valve hole 68 via the supply passage 48 and the third port 76. The pressure Pc in the valve hole 68 is communicated with the plunger chamber 79 via the small chamber 86, the communication passage 85 and the communication groove 84. Accordingly, the pressure in the valve hole 68 is equalized with the pressure of the plunger chamber 79. The valve body 67 is urged by the pressure Pc in the valve hole 68 in a direction opening the valve hole 68. The valve body 67 is also urged by the pressure Pc in the plunger chamber 79, which acts on the distal end of the second rod 83, in a direction closing the valve hole 68. Thus, the pressure Pc acting on the valve body 67 is canceled. That is, the crank chamber pressure Pc does not affect the movement of the valve body 67.

As described above, the pressures Pd and Pc acting on the valve body 67 are canceled to the minimum level. Therefore, the valve body 67 does not need to be moved against the discharge pressure Pd or the crank chamber pressure Pc. Thus, the attractive force between the core 78 and the plunger 80 does not to be increased for moving the valve body 67. This improves the control accuracy of the valve 49 without enlarging the size of the solenoid 65.

A variable displacement compressor according to a second embodiment of the present invention will now be described with reference to FIGS. 4, 7 and 8. The differences from the first embodiment will mainly be discussed below, and like or the same reference numerals are given to those components that are like or the same as the corresponding components of the first embodiment.

Figure 7:
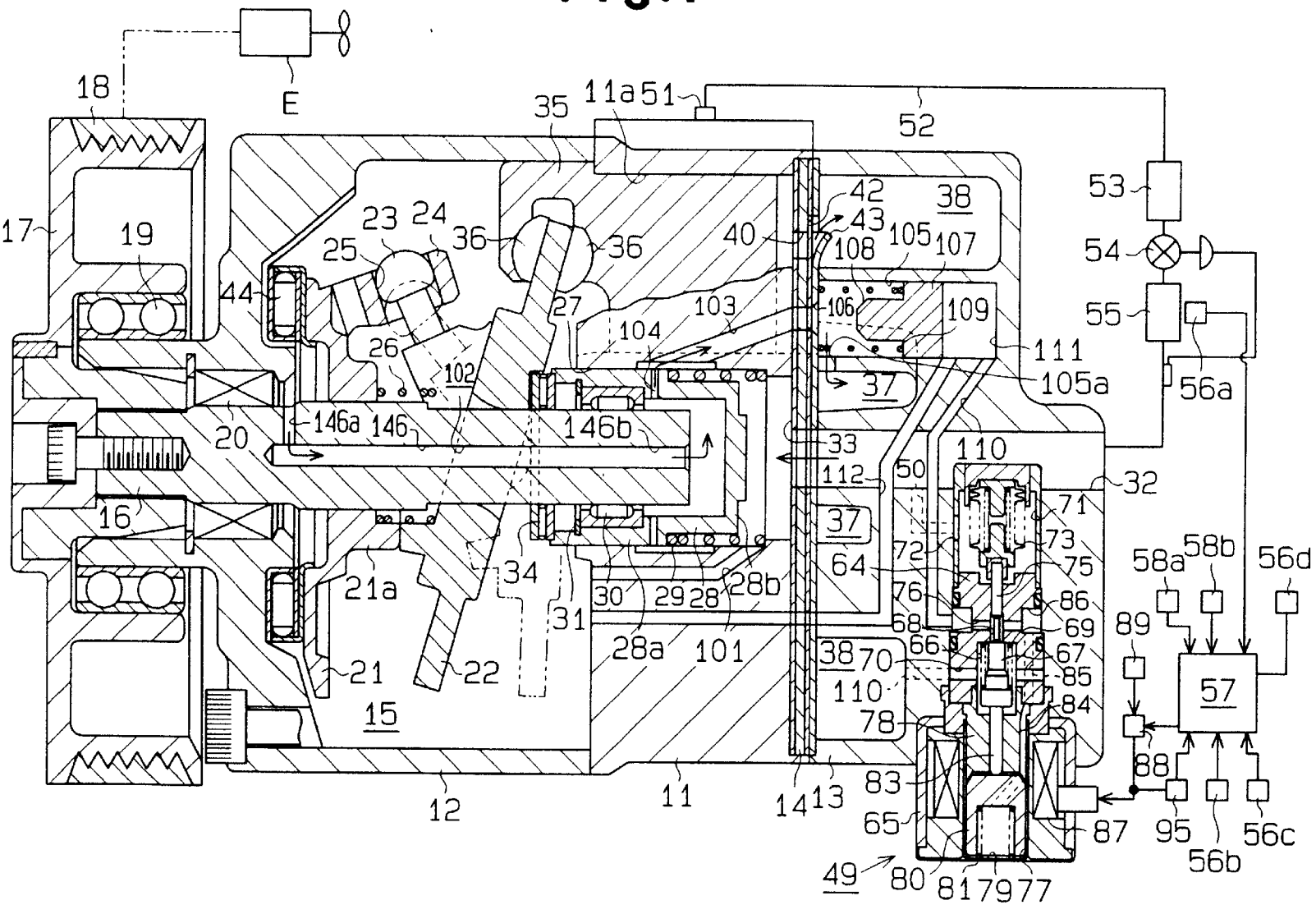
FIG. 7 is a cross-sectional view illustrating a variable displacement compressor according to a second embodiment of the present invention when the inclination of the swash plate is maximum.
Figure 8:
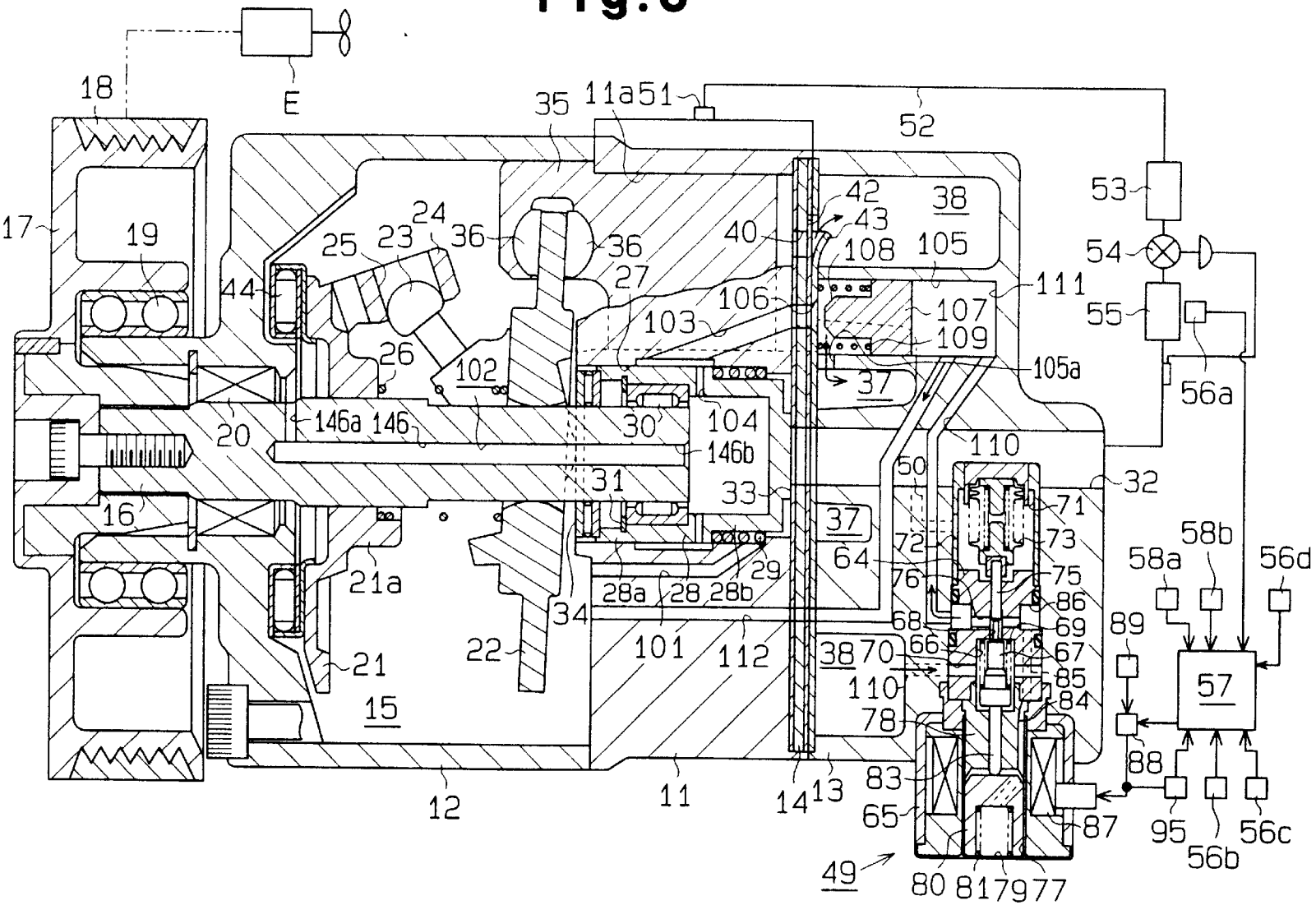
FIG. 8 is a cross-sectional view illustrating a variable displacement compressor of FIG. 7 when the inclination of the swash plate is minimum.

As shown in FIGS. 7 and 8, a second suction passage 101, defined in the cylinder block 11, communicates the shutter chamber 27 with the crank chamber 15. Refrigerant gas supplied to the shutter chamber 27 from the suction passage 32 is drawn into the crank chamber 15 via the second suction passage 101.

An introduction passage 102 communicates the crank chamber 15 with the suction chamber 37. Refrigerant gas in the crank chamber 15 is drawn into the suction chamber 37 via the introduction passage 102. The passage 102 includes a first passage 146, through holes 104, a second passage 103, a valve chamber 105 and a hole 105*a*. The first passage 146 is defined at the center portion of the rotary shaft 16 along the axis of the shaft 16. The first passage 146 has an inlet 146*a*, which opens to the crank chamber 15 in the vicinity of the lip seal 20, and an outlet 146*b*, which opens to the interior of the shutter 28. A plurality of through holes 104 are formed in the peripheral wall near the rear end of the shutter 28. The holes 104 communicate the interior of the shutter 28 with the second passage 103, which is defined in the cylinder block 11 and the valve plate 14. The valve chamber 105 is defined in the rear housing 13 and is communicated with the second passage 103. The hole 105*a* communicates the valve chamber 105 with the suction chamber 37.

A tapered outlet 106 is defined in an end of the second passage 103 that opens in the valve chamber 105. A valve body 107, which functions as a spool valve, is slidably housed in the valve chamber 105. A tapered restricter 108 is defined on an end of the valve body 107 facing the tapered outlet 106 of the passage 103. A spring 109 extends between the valve body 107 and the wall of the valve chamber 105 and urges the valve body 107 away from the outlet 106 of the passage 103.

A pressure control chamber 111 is defined by the rear end face of the valve body 107 and the valve chamber 105. A pressure supply passage 110 is defined in the rear housing 13 and communicates the discharge chamber 38 with the chamber 111. The displacement control valve 49 is accommodated in the rear housing 13 and is located in the passage 110. A pressure release passage 112 is defined in the rear housing 13, the valve plate 14 an the cylinder block 11 and communicates the chamber 111 with the crank chamber 15.

As shown in FIG. 4, the computer 57 according to the second embodiment functions as a current value commander 193 instead of the dither controller 93 in the first embodiment. The commander 193 receives a target current value computed by the target current determiner 92 and transmits the target current value to a driver 188. The driver 188 converts a constant current into an undulating current having a predetermined frequency. Specifically, the driver 188 inputs a constant direct current (flat current) from the battery 89. Then the driver 188 converts the current into an undulating current having a predetermined frequency, the average value of which matches a target value transmitted from the commander 193. The driver 188 then transmits the undulating current to the coil 87 of the valve 49. Therefore, the average value of the undulating current to the coil 87 is changed in accordance with the changes in the target current value from the commander 193.

The current value commander 93 inputs data from the comparator 94 and adjusts the current value to the driver 88 based on the data from the comparator 94. Specifically, the commander 93 adjusts the current value to the driver 88 such that the average value of the actual undulating current in the coil 87 matches the target current value.

The operation of the compressor according to the second embodiment will hereafter be described.

When the compressor is operating, refrigerant gas in the external refrigerant circuit 52 is drawn into the crank chamber 15 via the suction passage 34, the shutter chamber 27 and the second suction passage 101. Refrigerant gas in the crank chamber 15 is then drawn into the suction chamber 37 via the introduction passage 102, which includes the first passage 146, the through hole 104, the second passage 103, the valve chamber 105 and the hole 105*a*. The crank chamber 15 constitutes a part of the passage between the refrigerant circuit 52 and the suction chamber 37.

Suppose the cooling load is great, the average value of undulating current supplied to the coil 87 in the valve 49 is increased. This increases the average magnitude of the attractive force between the fixed core 78 and the plunger 80, thereby increasing the resultant force that urges the valve body 67 in a direction closing the valve hole 68. Decreasing the opening of valve hole 68 by the valve body 67 reduces the amount of gas flow from the discharge chamber 38 to the pressure control chamber 111 via the supply passage 110. Refrigerant gas in the chamber 111 flows into the crank chamber 15 via the passage 112. This lowers the pressure in the chamber 111 thereby moving the valve body 107 rearward, or away from the tapered outlet 106. Accordingly, the restriction amount of the outlet 106 by the restricter 108 of the valve body 107 is decreased. Decreasing the restriction amount, or increasing the opening of the outlet 106, increases the amount of gas flow from the crank chamber 15 into the suction chamber 37 via the passage 102. This increases the pressure in the suction chamber 37. Therefore, the difference between the pressure Pc in the crank chamber 15 and the pressure in each cylinder bore 11*a* is small. This increases the inclination of the swash plate 22, thereby allowing the compressor to operate at a large displacement.

When the valve hole 68 in the valve 49 is completely closed by the valve body 67, the supply passage 110 is closed. This stops supply of refrigerant gas from the discharge chamber 38 to the pressure control chamber 111. This further lowers the pressure in the pressure control chamber 111 thereby maximizing the opening between the outlet 106 and the valve body 107. Thus, the pressure in the suction chamber 37 is substantially equal to the pressure Pc in the crank chamber 15. The inclination of the swash plate 22 thus becomes maximum as shown in FIG. 7, and the compressor operates at the maximum displacement.

When the supply passage 110 is closed by the valve 49, refrigerant gas in the discharge chamber 38 is supplied to the refrigerant circuit 52 and is not supplied to the crank chamber 15 via the passages 110 and 112.

Suppose the cooling load is small, the average value of undulating current supplied to the coil 87 in the valve 49 is lowered. This decreases the average magnitude of the attractive force between the core 78 and the plunger 80 thereby decreasing the resultant force that urges the valve body 67 in a direction closing the valve hole 68. Increasing the opening between valve hole 68 and the valve body 67 increases the amount of gas flow from the discharge chamber 38 to the pressure control chamber 111 via the supply passage 110. This increases the pressure in the chamber 111 thereby moving the valve body 107 forward, or toward the tapered outlet 106. Accordingly, the restriction amount between the restricter 108 and the outlet 106 is increased. Increasing the restriction amount, or decreasing the opening of the outlet 106, decreases the amount gas flow from the crank chamber 15 into the suction chamber 37 via the passage 102. This lowers the pressure in the suction chamber 37. Therefore, the difference between the pressure Pc in the crank chamber 15 and the pressure in each cylinder bore 11*a* is great. This decreases the inclination of the swash plate 22 as shown in FIG. 8 thereby allowing the compressor to operate at a small displacement.

If cooling load becomes zero, current supply to the coil 87 of the valve 49 is stopped. This eliminates the magnetic attractive force between the core 78 and the plunger 80. The valve body 67 is moved to a position that maximizes the opening of the valve hole 68. Accordingly, the supply passage 110 is fully opened. This further increases the gas flow from the discharge chamber 38 to the pressure control chamber 111 thereby increasing the pressure in the chamber 111. The pressure moves the valve body 107 forward and maximizing the restriction between the outlet 106 and the valve body 107. The maximum restriction minimizes gas flow from the crank chamber 15 to the suction chamber 37 and lowers the pressure in the suction chamber 37. This minimizes the inclination of the swash plate 22 thereby allowing the compressor to operate at the minimum displacement.

As in the first embodiment, the minimum inclination of the swash plate 22 causes the shutter 28 to close the supply passage 32. This stops gas flow from the refrigerant circuit 52 into the suction chamber 37. In this state, refrigerant gas circulates within the compressor traveling through the discharge chamber 38, the supply passage 110, the pressure control chamber 111, the pressure release passage 112, the crank chamber 15, the introduction passage 102, the suction chamber 37 and the cylinder bores 11*a*.

The second embodiment has the substantially the same effect as the first embodiment.

The present invention may be alternatively embodied in the following forms:

(1) In the first embodiment, a bleeding passage may be formed for communicating the crank chamber 15 with the suction chamber 37 and the displacement control valve 49 may be located in the bleeding passage. In this case, the control valve 49 is designed such that the force urging the valve body 67 in a direction opening the valve hole 68 is increased by an increase in the average value of the undulating current to the coil 87.

(2) In the compressors according to the first embodiment and the preceding embodiment (1), the undulating current may be supplied to the coil 87 in the control valve 49 in the manner of the second embodiment.

(3) In the second embodiment, undulating current may be supplied to the coil 87 of the control valve 49 in the manner of the first embodiment.

(4) The present invention may be embodied in a clutch type variable displacement compressor and in a method for controlling it.

Therefore, the present examples and embodiments are to be considered as illustrative and not restrictive and the invention is not to be limited to the details given herein, but may be modified within the scope and equivalence of the appended claims.

What is claimed is:

1. A compressor having a drive plate located in a crank chamber and tiltably mounted on a drive shaft and a piston operably coupled to the drive plate and located in a cylinder bore, wherein said drive plate converts rotation of the drive shaft to reciprocating movement of the piston in the cylinder bore, said piston compressing gas supplied to the cylinder bore from an external circuit by way of a suction chamber and discharging the compressed gas to the external circuit by way of a discharge chamber, wherein the inclination of the drive plate is variable according to a difference between the pressure in the crank chamber and the pressure in the cylinder bore, said piston moving by a stroke based on the inclination of the drive plate to control the displacement of the compressor, said compressor comprising:

means for adjusting the pressure in one of the crank chamber and the suction chamber to vary the difference between the pressure in the crank chamber and the pressure in the cylinder bore, wherein said adjusting means includes a gas passage for passing the gas used for adjusting the pressure and a control valve for adjusting the amount of the gas flowing in the gas passage;

wherein said control valve includes a valve body for adjusting the opening size of said gas passage, said valve body being movable in the first direction and in a second direction opposite to a first direction, wherein said valve body moves in the first direction to open the gas passage and moves in the second direction to close the gas passage, a reacting member for reacting to the pressure of the gas supplied to the compressor from the external circuit, wherein said reacting member moves the valve body in accordance with the pressure of the gas supplied to the compressor from the external circuit, and a solenoid for biasing the valve body in one of the first direction and the second direction with a force based on a value of electric current supplied to the solenoid; and means for supplying undulating current to the solenoid, wherein said supplying means varies the average value of the undulating current to vary the biasing force of the solenoid.

2. The compressor according to claim 1, wherein said supplying means includes:

means for determining a target current value based on the operation state of the compressor;

means for converting a constant current into the undulating current; and means for controlling said converting means to coincide the average value of the undulating current supplied to the solenoid with the target current value.

3. The compressor according to claim 2, wherein said controlling means includes means for computing a duty ratio based on the target current value, wherein said converting means converts the constant current into the undulating current having the average value that coincides the target current value based on the duty ratio computed by said computing means.

4. The compressor according to claim 2, wherein said converting means converts the constant current into the undulating current, said undulating current having a predetermined frequency and the average value that coincides the target current value based on the target current value transmitted from said controlling means.

5. The compressor according to claim 2, wherein said supplying means further includes means for detecting the average value of the undulating current flowing in the solenoid, wherein said controlling means controls said converting means to coincide the average value of the actual undulating current flowing in the solenoid with the target current value based on comparison of the average value of the undulating current detected by said detecting means and the target current value.

6. The compressor according to claim 2, wherein said supplying means further includes a battery for supplying the constant current to said converting means.

7. The compressor according to claim 1, wherein said solenoid is opposed to the reacting member with respect to the valve body, wherein said solenoid has a fixed core, a plunger facing the core to move toward or away from the core, and a coil provided around the core and the plunger, wherein the undulating current supplied to the coil produces a magnetic attractive force for biasing the valve body between the core and the plunger in accordance with the value of the undulating current.

8. The compressor according to claim 7, wherein said control valve includes:

a first transmitting member placed between the reacting member and the valve body, wherein said reacting member moves the valve body in the second direction via the first transmitting member in accordance with increase of the pressure of the gas supplied to the compressor from the external circuit; and a second transmitting member placed between the plunger and the valve body, wherein the plunger biases the valve body in the second direction via the second transmitting member by the magnetic attractive force.

9. The compressor according to claim 8, wherein said control valve further includes:

a pressure chamber;

an introduction passage for introducing the gas supplied to the compressor from the external circuit into the pressure chamber; and said reacting member including a bellows located in the pressure chamber, said bellows being arranged to be collapsed in accordance with increase of the pressure in the pressure chamber and expanded in accordance with decrease of the pressure in the pressure chamber.

10. The compressor according to claim 1, wherein said gas passage includes a supply passage for connecting the discharge chamber with the crank chamber, wherein said control valve is placed midway in the supply passage for adjusting the amount of the gas introduced into the crank chamber from the discharge chamber through the supply passage to control the pressure in the crank chamber.

11. The compressor according to claim 1, wherein said adjusting means includes:

a suction passage for connecting the external circuit with the crank chamber;

an introducing passage for connecting the crank chamber with the suction chamber, wherein the gas is supplied to the suction chamber from the external circuit through the suction passage, the crank chamber and the introducing passage;

an adjusting valve placed midway in the introducing passage for adjusting the amount of the gas supplied to the suction chamber from the external circuit to control the pressure in the suction chamber;

said gas passage including a pressure applying passage for introducing the gas to the adjusting valve from the discharge chamber to apply the pressure in the discharge chamber to the adjusting valve; and said control valve being placed midway in the pressure applying passage for adjusting the amount of the gas introduced to the adjusting valve from the discharge chamber through the pressure applying passage to control the pressure applied to the adjusting valve, wherein said adjusting valve controls the opening size of the introducing passage in accordance with the pressure applied to the adjusting valve.

12. The compressor according to claim 1 further comprising an external driving source coupled directly to the drive shaft to rotate the drive shaft.

13. A compressor having a drive plate located in a crank chamber and tiltably mounted on a drive shaft and a piston operably coupled to the drive plate and located in a cylinder bore, wherein said drive plate converts rotation of the drive shaft to reciprocating movement of the piston in the cylinder bore, said piston compressing gas supplied to the cylinder bore from an external circuit by way of a suction chamber and discharging the compressed gas to the external circuit by way of a discharge chamber, wherein the inclination of the drive plate is variable according to a difference between the pressure in the crank chamber and the pressure in the cylinder bore, said piston moving by the stroke based on the inclination of the drive plate to control the displacement of the compressor, said compressor comprising:

means for adjusting the pressure in one of the crank chamber and the suction chamber to vary the difference between the pressure in the crank chamber and the pressure in the cylinder bore, wherein said adjusting means includes a gas passage for passing the gas used for adjusting the pressure and a control valve for adjusting the amount of the gas flowing in the gas passage;

wherein said control valve includes a valve body for adjusting the opening size of said gas passage, said valve body being movable in the first direction and in a second direction opposite to the first direction, wherein said valve body moves in the first direction to open the gas passage, and moves in the second direction to close the gas passage, a reacting member for reacting to the pressure of the gas supplied to the compressor from the external circuit, wherein said reacting member moves the valve body in accordance with the pressure of the gas supplied to the compressor from the external circuit, and a solenoid opposed to the reacting member with respect to the valve body to bias the valve body in one of the first direction and the second direction, wherein said solenoid has a fixed core, a plunger facing the core to move toward or away from the core, and a coil provided around the core and the plunger, wherein electric current supplied to the coil produces a magnetic attractive force for biasing the valve body between the core and the plunger in accordance with the value of the current; and means for supplying undulating current to the coil, wherein said supplying means includes means for determining the target current value based on the operation state of the compressor, means for converting a constant current into the undulating current, and means for controlling said converting means to coincide the average value of the undulating current supplied to the coil with the target current value, wherein the biasing force based on the magnetic attractive force between the core and the plunger varies in accordance with the average value of the undulating current supplied to the coil.

14. The compressor according to claim 13, wherein said supplying means further includes a battery for supplying the constant current to said converting means.

15. The compressor according to claim 14, wherein said controlling means includes means for computing a duty ratio based on the target current value, wherein said converting means converts the constant current into the undulating current having the average value that coincides the target current value based on the duty ratio computed by said computing means.

16. The compressor according to claim 15, wherein said supplying means further includes means for detecting the average value of the undulating current flowing in the coil, wherein said computing means adjusts the duty ratio to coincide the average value of the actual undulating current flowing in the coil with the target current value based on comparison of the average value of the undulating current detected by said detecting means and the target current value.

17. The compressor according to claim 14, wherein said converting means converts the constant current into the undulating current, said undulating current having a predetermined frequency and the average value that coincides the target current value based on the target current value transmitted from said controlling means.

18. The compressor according to claim 17, wherein said supplying means further includes means for detecting the average value of the undulating current flowing in the coil, wherein said controlling means adjusts the current value to be transmitted to said converting means to coincide the average value of the actual undulating current flowing in the coil with the target current value based on comparison of the average value of the undulating current detected by said detecting means and the target current value.

19. The compressor according to claim 14, wherein said control valve includes:

a first transmitting member placed between the reacting member and the valve body, wherein said reacting member moves the valve body in the second direction via the first transmitting member in accordance with increase of the pressure of the gas supplied to the compressor from the external circuit; and a second transmitting member placed between the plunger and the valve body, wherein the plunger biases the valve body in the second direction via the second transmitting member by the magnetic attractive force.

20. The compressor according to claim 19, wherein said control valve further includes:

a pressure chamber;

an introduction passage for introducing the gas supplied to the compressor from the external circuit into the pressure chamber; and said reacting member including a bellows located in the pressure chamber, said bellows being arranged to be collapsed in accordance with increase of the pressure in the pressure chamber and expanded in accordance with decrease of the pressure in the pressure chamber.

21. The compressor according to claim 14, wherein said gas passage includes a supply passage for connecting the discharge chamber with the crank chamber, wherein said control valve is placed midway in the supply passage for adjusting the amount of the gas introduced into the crank chamber from the discharge chamber through the supply passage to control the pressure in the crank chamber.

22. The compressor according to claim 14, wherein said adjusting means includes:

a suction passage for connecting the external circuit with the crank chamber;

an introducing passage for connecting the crank chamber with the suction chamber, wherein the gas is supplied to the suction chamber from the external circuit through the suction passage, the crank chamber and the introducing passage;

an adjusting valve placed midway in the introducing passage for adjusting the amount of the gas supplied to the suction chamber from the external circuit to control the pressure in the suction chamber;

said gas passage including a pressure applying passage for introducing the gas to the adjusting valve from the discharge chamber to apply the pressure in the discharge chamber to the adjusting valve; and said control valve being placed midway in the pressure applying passage for adjusting the amount of the gas introduced to the adjusting valve from the discharge chamber through the pressure applying passage to control the pressure applied to the adjusting valve, wherein said adjusting valve controls the opening size of the introducing passage in accordance with the pressure applied to the adjusting valve.

23. The compressor according to claim 14 further comprising an external driving source coupled directly to the drive shaft to rotate the drive shaft.

24. A method for controlling the variable displacement compressor, said compressor having a drive plate located in a crank chamber and tiltably mounted on a drive shaft and a piston operably coupled to the drive plate and located in a cylinder bore, wherein said drive plate converts rotation of the drive shaft to reciprocating movement of the piston in the cylinder bore, said piston compressing gas supplied to the cylinder bore from an external circuit by way of a suction chamber and discharging the compressed gas to the external circuit by way of a discharge chamber, wherein the inclination of the drive plate is variable according to a difference between the pressure in the crank chamber and the pressure in the cylinder bore, said piston moving by a stroke based on the inclination of the drive plate to control the displacement of the compressor, said method comprising the steps of:

adjusting the pressure in one of the crank chamber and the suction chamber with adjusting means to vary the difference between the pressure in the crank chamber and the pressure in the cylinder bore, wherein said adjusting means includes a gas passage for passing the gas used for adjusting the pressure and a control valve for adjusting the amount of the gas flowing in the gas passage, said control valve including a valve body, a reacting member and a solenoid;

adjusting the opening size of said gas passage with said valve body, wherein said valve body is movable in the first direction and in a second direction opposite to the first direction, said valve body moving in the first direction to open the gas passage and moving in the second direction to close the gas passage;

detecting the pressure of the gas supplied to the compressor from the external circuit with said reacting member, wherein said reacting member moves the valve body in accordance with the pressure of the gas supplied to the compressor from the external circuit;

biasing the valve body in one of the first direction and the second direction with said solenoid, wherein said solenoid biases the valve body with the force based on a value of electric current supplied to the solenoid; and supplying undulating current to the solenoid, wherein the biasing force of the solenoid varies in accordance with the average value of the undulating current.

25. A compressor having an inclinable drive plate located in a crank chamber and a piston coupled to the drive plate and located in a cylinder bore, wherein the piston compresses gas supplied to the cylinder bore from an external circuit through a suction chamber and discharges the compressed gas to the external circuit from the cylinder bore through a discharge chamber, wherein the inclination of the drive plate is variable according to a difference between the pressure in the crank chamber and the pressure in the cylinder bore, the inclination of the drive plate determining the piston stroke and the compressor displacement, the compressor comprising:

means for adjusting the pressure in one of the crank chamber and the suction chamber to vary the difference between the pressure in the crank chamber and the pressure in the cylinder bore, wherein the adjusting means includes a gas passage for passing the gas used for adjusting the pressure and a control valve for adjusting the amount of the gas flowing in the gas passage, wherein the control valve includes:

a valve chamber located in the gas passage;

a valve body located in the valve chamber to adjust the opening size of the gas passage;

a solenoid, wherein the solenoid includes a coil, a plunger chamber and a plunger, the plunger being located in the plunger chamber, wherein the presure in the plunger chamber is different from the pressure in the valve chamber, and wherein the current supplied to the coil produces a magnetic force for actuating the plunger in accordance with the value of the current;

a guide hole extending between the valve chamber and the plunger chamber; and a rod slidably supported by the wall of the guide hole to operably connect the plunger to the valve body, wherein the plunger biases the valve body in one direction through the rod by the magnetic force; and means for supplying undulating current to the coil, wherein the supplying means varies the average value of the undulating current to vary the biasing force of the plunger.

26. A compressor having an inclinable drive plate located in a crank chamber and a piston coupled to the drive plate and located in a cylinder bore, wherein the piston compresses gas supplied to the cylinder bore from an external circuit through a suction chamber and discharges the compressed gas to the external circuit from the cylinder bore through a discharge chamber, wherein the inclination of the drive plate is variable according to a difference between the pressure in the crank chamber and the pressure in the cylinder bore, the inclination of the drive plate determining the piston stroke and the compressor displacement, the compressor comprising:

means for adjusting the pressure in one of the crank chamber and the suction chamber to vary the difference between the pressure in the crank chamber and the pressure in the cylinder bore, wherein the adjusting means includes a gas passage for passing the gas used for adjusting the pressure and a control valve for adjusting the amount of the gas flowing in the gas passage, wherein the control valve includes:

a valve chamber located in the gas passage;

a valve body located in the valve chamber to adjust the opening size of the gas passage;

a pressure chamber, wherein the gas supplied to the compressor from the external circuit is introduced into the pressure chamber, and wherein the pressure in the pressure chamber is different from the pressure in the valve chamber;

a reacting member located in the pressure chamber to move the valve body in accordance with the pressure in the pressure chamber;

a guide hole extending between the valve chamber and the pressure chamber;

a rod slidably supported by the wall of the guide hole to operably connect the reacting member to the valve body; and a solenoid for biasing the valve body in one direction with a force based on a value of electric current supplied to the solenoid, and means for supplying undulating current to the solenoid, wherein the supplying means varies the average value of the undulating current to vary the biasing force of the solenoid.

27. The compressore according to claim 26, wherein the guide hole is a first guide hole, and the rod is a first rod, wherein the solenoid includes a coil, a plunger chamber and a plunger, the plunger being located in the plunger chamber, wherein the pressure in the plunger chamber is different from the pressure in the valve chamber, wherein the undulating current supplied to the coil produces a magnetic force for acuating the plunger in accordance with the value of the undulating current, wherein a second guide hole extends between the valve chamber and the plunger chamber, and wherein a second rod is slidably supported by the wall of the second guide hole to operably connect the plunger to the valve body.

28. A compressor having an inclinable drive plate located in a crank chamber and a piston coupled to the drive plate and located in a cyclinder bore, wherein the piston compresses gas supplied to the cyclinder bore from an external circuit through a suction chamber and discharges the compressed gas to the external circuit from the cylinder bore through a discharge chamber, wherein the inclination of the drive plate is variable according to a difference between the pressure in the crank chamber and the pressure in the cylinder bore, the inclination of the drive plate determining the piston stroke and the compressor displacement, the compressor comprising:

means for adjusting the pressure in one of the crank chamber and the suction chamber to vary the difference between the pressure in the crank chamber and the pressure in the cylinder bore, wherein the adjusting means includes a gas passage for passing the gas used for adjusting the pressure and a control valve for adjusting the amount of the gas flowing in the gas passage, wherein the control includes:

a valve housing;

a valve body for adjusting the opening size of the gas passage;

a reacting member for moving the valve body in accordance with the pressure of the gas supplied to the compressor from the external circuit;

a first rod slidably supported by the valve housing to operably connect the reacting member to the valve body;

a solenoid for biasing the valve body in one direction with a force based on a value of electric current supplied to the solenoid; and a second rod slidably supported by the valve housing to operably connect the solenoid to the valve body; and means for supplying undulating current to the solenoid, wherein the supplying means varies the average balue of the undulating current to vary the biasing force of the solenoid.

29. The compressor according to claim 28, wherein the solenoid includes a coil, a plunger chamber and a plunger, the plunger being located in the plunger chamber, wherein the undulating current supplied to the coil produces a magnetic force for actuating the plunger in accordance with the value of the undulating current, wherein a valve chamber is located in the gas passage to accommodate the valve body, the pressure in the plunger chamber being different from the pressure in the valve chamber, wherein a guide hold extends between the valve chamber and the plunger chamber, and wherein the second rod is slidably supported by the wall of the guide hole.

30. The compressor according to claim 28, wherein the control valve further includes:

a valve chamber located in the gas passage to accommodate the valve body;

a pressure chamber for accommodating the reacting member, wherein the gas supplied to the compressor from the external circuit is introduced into the pressure chamber, and wherein the pressure in the pressure chamber is different from the pressure in the valve chamber; and a guide hole extending between the valve chamber and the pressure chamber, wherein the first rod is slidably supported by the wall of the guide hole.

31. The compressor according to claim 28, wherein the gas passage is a supply passage for connecting the discharge chamber with the crank chamber, wherein the valve body is located in the supply passage, and wherein the first and second rods extend from the valve body opposite directions.

32. The compressor according to claim 28, wherein the first rod and the second rod coaxially extend from the valve body in opposite directions, and wherein the valve body is supported by the valve housing though the rods.

* * * * *

UNITED STATES PATENT AND TRADEMARK OFFICE

CERTIFICATE OF CORRECTION

PATENT NO. : 6,126,405
DATED : October 3, 2000
INVENTOR(S) : Masahiro Kawaguchi et al.

It is certified that error appears in the above-identified patent and that said Letters Patent is hereby corrected as shown below:

Title page,
Item [56] U.S. PATENT DOCUMENTS, add -- 4,838,766 6/1989 Kimura et al --

Column 9,
Line 18 please change "plunger" to -- valve body --
Line 19 please change "plunge" to -- plunger --

Column 12,
Line 1 please change "3B" to -- 38 --

Column 19,
Line 28 please delete ","

Column 24,
Line 10 please change "balue" to -- value --
Line 41 before "opposite", insert -- in --.

Signed and Sealed this

Twenty-eighth Day of May, 2002

*Attest:*

*Attesting Officer*

JAMES E. ROGAN
*Director of the United States Patent and Trademark Office*